US006412311B1

(12) United States Patent
Nakai

(10) Patent No.: US 6,412,311 B1
(45) Date of Patent: Jul. 2, 2002

(54) KNITTING FABRIC AND METHOD OF KNITTING IT

(75) Inventor: Syunichi Nakai, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 09/926,350

(22) PCT Filed: Apr. 12, 2000

(86) PCT No.: PCT/JP00/02412

§ 371 (c)(1),
(2), (4) Date: Oct. 18, 2001

(87) PCT Pub. No.: WO00/63475

PCT Pub. Date: Oct. 26, 2000

(30) Foreign Application Priority Data

Apr. 20, 1999 (JP) ..... 11-111717

(51) Int. Cl.[7] ..... D04B 7/00
(52) U.S. Cl. ..... 66/64
(58) Field of Search ..... 66/64, 60 R, 69, 66/70, 71, 76, 77, 169 R, 170, 171, 198

(56) References Cited

U.S. PATENT DOCUMENTS 2,100,861 A * 11/1937 Lochhead ..... 66/64
5,979,193 A * 11/1999 Murata ..... 66/61

FOREIGN PATENT DOCUMENTS

| | | |
|---|---|---|
| EP | 768411 A | 4/1997 |
| JP | 7-138849 A | 5/1995 |
| JP | 9-111622 A | 4/1997 |
| JP | 5-321101 A | 7/1999 |

* cited by examiner

*Primary Examiner*—Danny Worrell
(74) *Attorney, Agent, or Firm*—Arent Fox Kintner Plotkin & Kahn, PLLC

(57) ABSTRACT

A method of knitting a knitting fabric by use of a flat knitting machine having a plurality of yarn feeders, wherein the knitting fabric has at least a first region and a second region in a course including a stitch loop formed in the second region smaller in size than a stitch loop formed in the first region, the method comprising the step that a first yarn and a second yarn are fed to the first region in a paralleled state so as to form a stitch course of the first region; the step that the first yarn is fed to the second region to form a first stitch course; and the step that the second yarn is used to form a second stitch course next to the first stitch course formed in the last step.

10 Claims, 5 Drawing Sheets

KNITTING FABRIC AND METHOD OF KNITTING IT

TECHNICAL FIELD

The present invention relates to a knitting fabric having regions of different stitch-loop size formed in a course and to a method of knitting it by use of a flat knitting machine.

BACKGROUND ART

A knitting fabric 100 having stitches of different size formed in a course is shown in FIG. 5. This knitting fabric has regions A and C knitted in the texture corresponding to e.g. 7 gauges and a region B knitted in a texture corresponding to e.g. 12 gauges.

In general, when this knitting fabric 100 is knitted, a yarn feeder 11, a yarn feeder 13 and a yarn feeder 15 are prepared for knitting the region A, the region B and the region C, respectively, so that stitch courses in the respective regions are formed by yarns delivered from their respective yarn feeders, as is the case with the knitting of an intersia knitting fabric. The yarn having a thickness corresponding to 7 gauge is prepared for the yard feeders 11 and 15 and the yarn having a thickness corresponding to 12 gauge is prepared for the yarn feeder 13, so that the stitch loops having the thicknesses corresponding to their respective gauges are formed to produce the textures corresponding to the gauges in the respective regions. Every time one stitch course is formed in the regions A and C, two stitch courses are formed in the region B, and the stitch loops at the ends of neighboring regions (21 and 23 in the diagram) are knitted by tuck stitching and like stitching, so as to prevent the knitting fabric from being split at the boundaries between the neighboring regions. When stitch loops in the respective regions are knitted with increased stitch-loop size difference between the regions, in other words, with increased gauge difference between the regions A and C and the region B (between 7 gauge and 12 gauge), the stitch loops in the regions A and C are usually knitted by half gauge using e.g. odd needles on needle beds.

In this conventional way of knitting, however, the number of yarns and yarn feeders corresponding to the number; of regions must be prepared, thus taking a lot of troublesome works with arrangement of the yarns and preliminary work on the knitting machine. In addition, the stitch loops at the boundaries between the neighboring regions are connected by tuck stitching, so that the strength at the boundaries of the regions is inevitably weaken and the tuck stitched part comes into prominence to cause impairment of the appearance of the knitting fabric.

The objective of the present invention is to remove the burdens of the arrangement of the yarns and the preliminary work on the knitting machine and also provide a knitting fabric having improved strength and appearance at the boundaries between the neighboring regions.

DISCLOSURE OF THE INVENTION

To accomplish the objective above, the present invention provides a method of knitting a knitting fabric by use of a flat knitting machine having a plurality of yarn feeders, wherein the knitting fabric has at least a first region and a second region in a course, including a stitch loop formed in the second region smaller in size than a stitch loop formed in the first region, the method comprising:

the step (A) that a first yarn and a second yarn are fed to the first region in a paralleled state so as to form a stitch course of the first region; and the step (B) comprises:

the step (B-1) that the first yarn is fed to the second region to form a first stitch course; and the step (B-2) that the second yarn is used to form a second stitch course next to the first stitch course formed in the step (B-1).

In the method above, the stitch course in the first region may be formed by use of half gauge using alternate needles.

Also, the present invention provides a knitting fabric knitted by use of a flat knitting machine, which has at least a first region and a second region in a course including a stitch loop formed in the second region smaller in size than a stitch loop formed in the first region, wherein the first region has a stitch course formed by a first yarn and a second yarn paralleled to each other; wherein the second region adjoining to the first region has two stitch courses comprising a first stitch course formed by the first yarn and a second stitch course formed by the second yarn next to the first stitch course.

In the knitting fabric, the stitch loop formed in the stitch course of the first region may be double as long as the stitch loop formed in the stitch course of the second region.

BEST MODE FOR CARRYING OUT THE INVENTION

Figure 1:
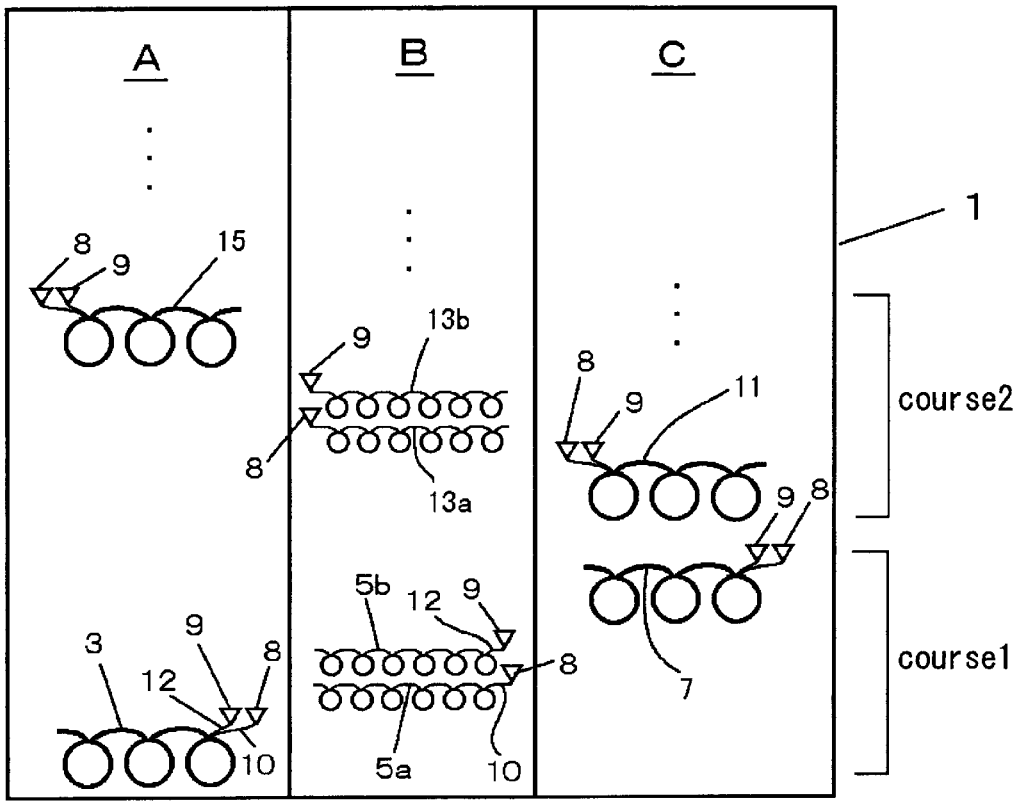
FIG. 1 is a diagram showing a stitch loop formation of each region of a knitting fabric knitted in accordance with an embodiment of the present invention.
Figure 2:
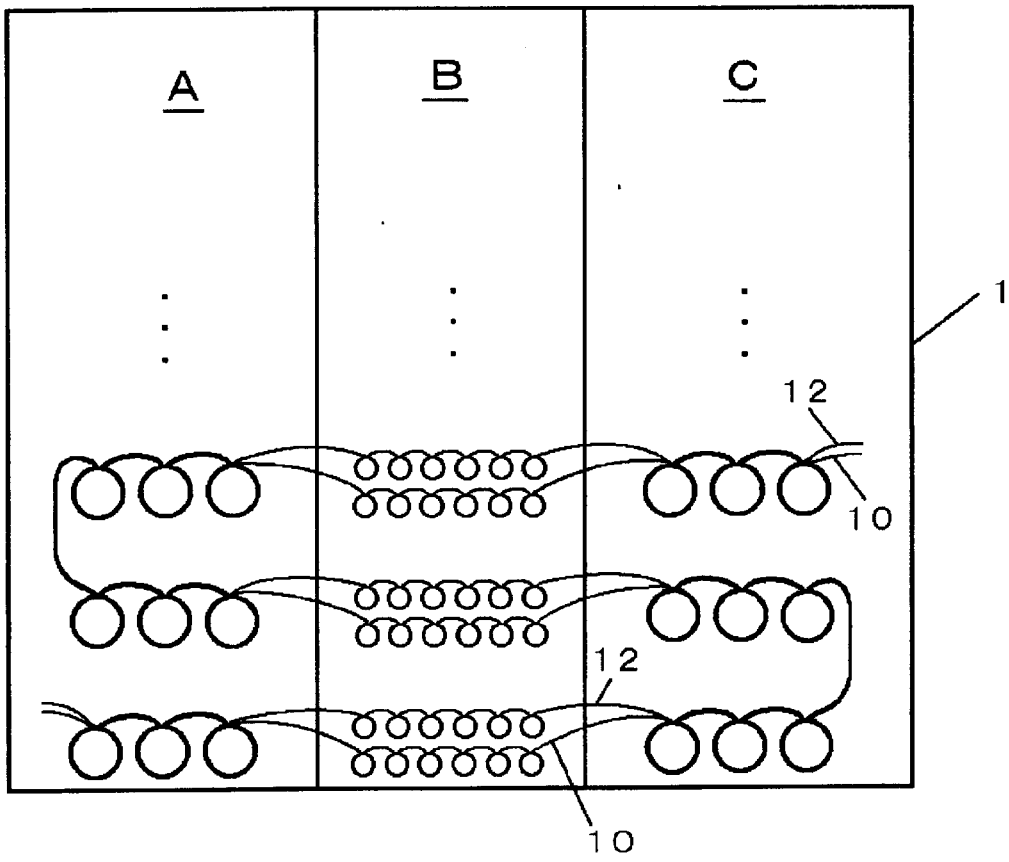
FIG. 2 is a diagram showing the connection between the stitch courses in the respective regions of the knitting fabric.

Certain preferred embodiments of the present invention will be described below with reference to the accompanying drawings. In the embodiments, reference is given to a knitting fabric wherein the number of stitch courses in the region B is twice as many as in the regions A and C at the both sides of the region B and is higher in stitch density than in those regions, such as a knitting fabric 1 wherein the region B is knitted in texture corresponding to finer gauges than in the regions A and C, as shown in FIG. 1. Illustrated in FIG. 2 is the knitting of the knitting fabric. For convenience of explanation, a decreased number of stitch loops forming the knitting fabric is shown in the diagrams.

Figure 3:
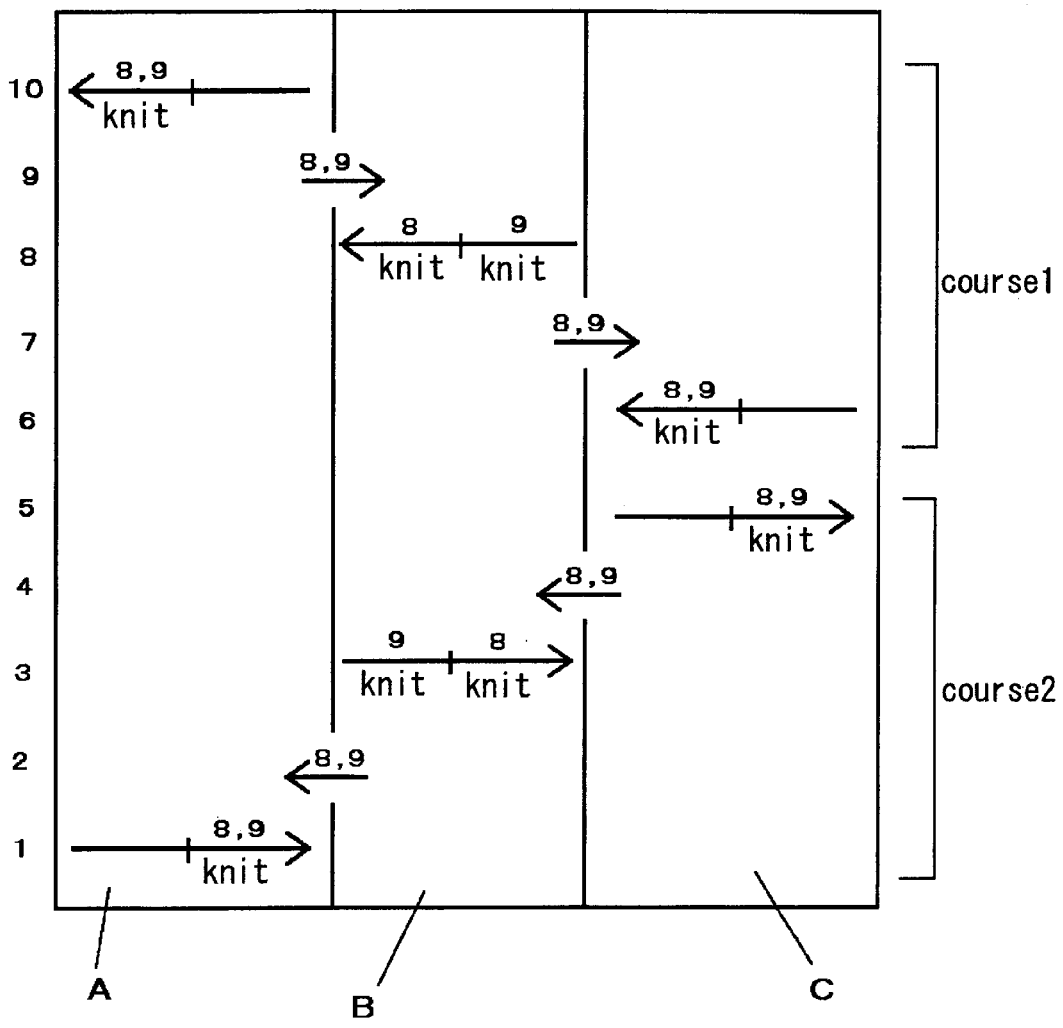
FIG. 3 is a diagram showing the steps to knit the knitting fabric in accordance with Embodiment 1.

The knitting of Embodiment 1 is performed by use of a flat knitting machine including a plurality of yarn feeders and a carriage (not shown) mounting thereon two leading and trailing knitting systems. Two yarn feeders 8, 9 and two yarns 10, 12 of the same kind set in those yarn feeders are used for knitting the knitting fabric. Illustrated in FIG. 3 is the knitting steps of this embodiment.

The knitting of the course 1 will be described first. In the step 1, the carriage is shifted rightward and the leading knitting system controls the yarn feeders 8, 9 to feed the yarns 10, 12 to the needles in the region A, so as to form the stitch course 3. In the step 2, the carriage is reversed in traveling direction to the left to return the yarn feeders 8, 9 back to the region A. In the step 3, the leading knitting system controls the yarn feeder 8 to form the stitch course 5a by use of the yarn feeder 8 and the trailing knitting system controls the yarn feeder 9. to form the stitch course 5b by use of the yarn feeder 9. In the step 4, the carriage is reversed in traveling direction to the left to return the yarn feeders 8, 9 back to the region B in the same manner as in the step 2. In the step 5, the carriage is shifted rightward again and the leading knitting system controls the yarn feeders 8, 9 to feed the yarns 10, 12 to the needles in the region C, so as to form the stitch course 7. These stitch courses are formed in the respective regions A–C and thereby the knitting of the course 1 is brought to completion. In the regions A and C, the yarns 10, 12 are fed in the paralleled state from the yarn feeders 8, 9, to form the second stitch courses.

It is to be noted that the term "the paralleled state" means the state that the yarns 10, 12 delivered from the yarn feeders 8, 9 are simultaneously fed to the same needle. It is also to be noted that the term "the course" used in the specification means the stitch line formed when the yarn feeder is traversed once over the knitting fabric 1, and the term "the stitch course" means the stitch line formed in each of the regions A, B and C. This means that in the course 1 mentioned above, one stitch course is formed in each of the regions A and C and two stitch courses are formed in the region B.

For the knitting of the sequent course 2, the knitting steps 6–10, which are opposite in knitting direction to the knitting steps 1–5 previously taken to form the course 1, are taken to form the stitch courses (11, 13*a*, 13*b* and 15) in the respective regions A–C. These steps 1–10 are repeatedly taken to knit a knitting fabric 1 having a desired length.

It is necessary to shape the knitting fabric into the state in which any undesired slack and drag was removed from the region B of the knitting fabric of different in texture from the regions A and C. For this purpose, the adjustment of lengths of the stitch loops is made so that the knitting fabric in the regions A and C and the knitting fabric in the region B in which the double courses are formed can be made equal in length to each other.

When the stitch courses in the regions A and C are formed by half gauge using alternate needles (a, c, e . . . ) on the needle beds and the stitch courses in the remaining region B are formed by full gauge using all needles (a, b, c . . . ), the knitting fabric including the regions A and C having the texture corresponding to e.g. 7 gauges and the region B having the texture corresponding to e.g. 12 gauges, whose texture difference is highlighted, can be obtained.

Then, reference will be given to Embodiment 2. The knitting of this embodiment is performed by use of a flat knitting machine having a yarn feeding device comprising a carriage mounting four knitting systems thereon and a traveling member which is set on thread passage rails along which needle beds are horizontally arranged and is driven in reciprocation in a traveling direction of the yarn feeders by drive means to move the yarn feeders in the traveling direction. This yarn feeding device can allow the yarn feeders to move absolutely independently of the movement of the carriage. This yarn feeding device is disclosed, for example, by Japanese Laid-open (Unexamined) Patent Publication No. Hei 11-1852 filed by the applicant of this application.

In the embodiment 2, since the step of making only the yarn feeders move, as is taken in the steps 2, 4, 7 and 9 of the embodiment 1, is taken simply by the yarn feeding device mentioned above, the need of the reverse operation of the carriage can be eliminated, thus providing the effect of improving the knitting efficiency.

Figure 4:
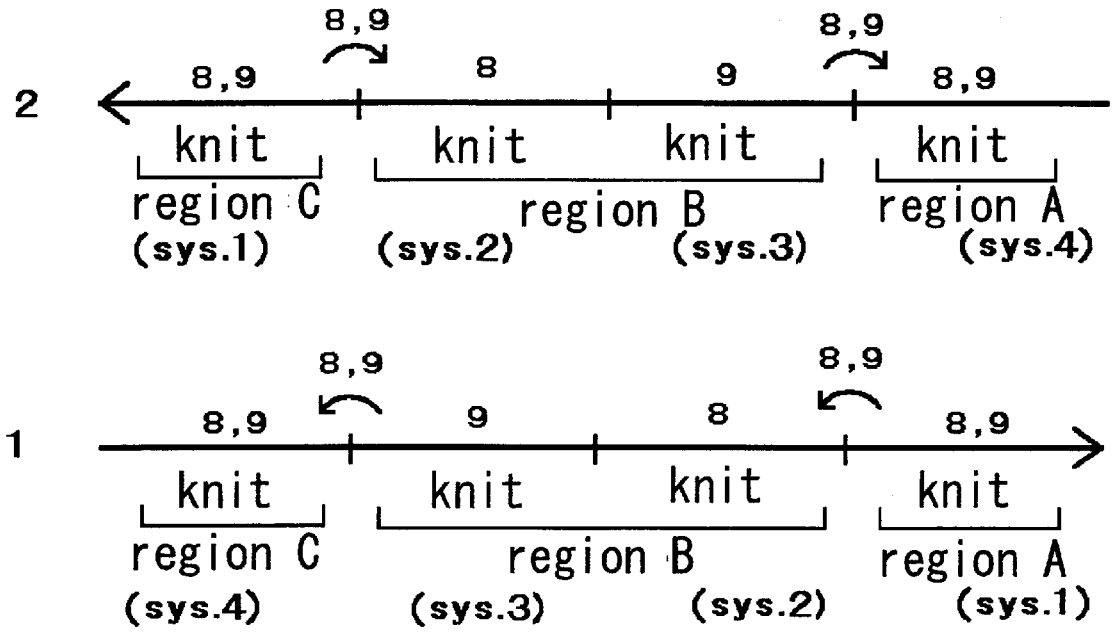
FIG. 4 is a diagram showing the steps to knit the knitting fabric in accordance with Embodiment 2.
Figure 5:
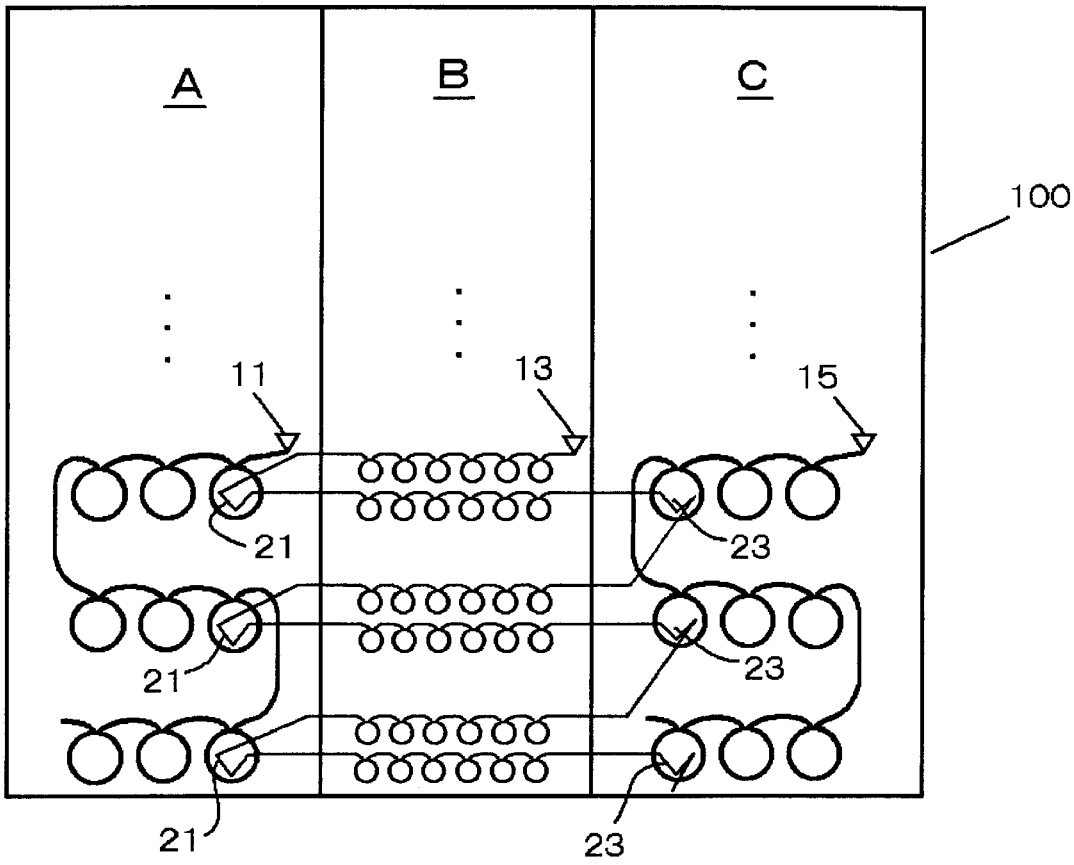
FIG. 5 is a diagram showing the connection between the stitch courses of the regions of the knitting fabric in accordance with the conventional art.

Illustrated in FIG. 4 is the knitting steps provided by the flat knitting machine mentioned above. The courses 1 and 2 are completed by a single reciprocating motion of the carriage. Specifically, in the step 1, the knitting system 1 controls the yarn feeders 8, 9 to form the stitch course of the region A by use of the yarn feeders 8, 9 and then the yarn feeding device is operated to return the yarn feeders 8, 9 back to the position over the region A before the knitting system 2 reaches the region B. Thereafter, the knitting system 2 controls the yarn feeder 8 to form the first stitch course 5*a* of the region B by use of the yarn feeder 8 and then the sequent knitting system 3 controls the yarn feeder 9 to form the second stitch coarse 5*b* by use of the yarn feeder 9. Then, after the knitting system 3 passes through the region B, the yarn feeding device is operated to return the yarn feeders 8, 9 back to the position over the region B before the knitting system 4 reaches the region C, as is the case with the above. Thereafter, the knitting system 4 controls the yarn feeders 8, 9 to form the stitch course 7 of the region C by use of the yarn feeders 8, 9. The knitting of the course 1 is completed through these steps.

In the sequent step 2, the knitting system 1 controls the yarn feeders 8, 9 to form the stitch course of the region C by use of the yarn feeders 8, 9 and then the yarn feeding device is operated to return the yarn feeders 8, 9 back to the position over the region C before the knitting system 2 reaches the region B. Then, the knitting system 2 controls the yarn feeder 8 to form the first stitch course 13*a* of the region B by use of the yarn feeder 8 and then the sequent knitting system 3 controls the yarn feeder 9 to form the second stitch coarse 13*b* by use of the yarn feeder 9. Then, the yarn feeding device is operated to return the yarn feeders 8, 9 back to the position over the region B before the system 4 reaches the region C, as is the case with the above. Thereafter, the knitting system 4 controls the yarn feeders 8, 9 to form the stitch course 15 of the region A by use of the yarn feeders 8, 9. The knitting of the course 2 is completed through these steps. These steps 1 and 2 are repeatedly taken to knit the knitting fabric 1 having a desired length.

Although certain preferred embodiments of the present invention are illustrated above, the present invention is not limited to these illustrated embodiments. Modifications may be made in the invention, such as, for example, using different kinds of knitting yarns as the substitution of the same kinds of yarns or knitting a plating knit by using the front yarn for the yarn feeder 8 and the back yarn for the yarn feeder 9 when the yarns are knitted in the paralleled state in the regions A and C, without departing from the spirit and scope of the invention.

Capabilities of Exploitation in Industry

According to the constitution of the present invention, the stitch course of the first region is formed in the state in which the first yarn and the second yarn are paralleled to each other, so that the stitch loops formed in this region are allowed to have doubled thickness by combination of the first yarn and the second yarn. On the other hand, in the second region, the first stitch course and the second stitch course are formed by singularly using a first yarn and a single second yarn, respectively, so as to have the stitch loops smaller in size than those in the first region. As a result of this, the stitch loops in the second region are smaller in thickness as well as in size than those in the first region. Also, since the stitch courses of the first region and second region are formed in the condition in which the first yarn and the second yarn are continuously fed, they are automatically joined firmly to each other without performing any tuck stitching at the boundaries therebetween. In addition, since the stitch loops are adjusted so that the length of the stitch course in the first region can be made equal to the length of the doubled stitch course in the second region, undesired slack and drag is taken up from any one of the regions of the knitting fabric. Further, since the stitch courses formed in the first region are knitted by using alternate needles, the stitch loops formed in the first region can be made larger than those in the second region using the full gauge, thus highlighting the texture difference between the regions.

What is claimed is:

1. A method of knitting a knit fabric by use of a flat knitting machine having a plurality of yarn feeders, wherein the knit fabric has at least a first region and a second region in a course, including a stitch loop formed in the second region smaller in size than a stitch loop formed in the first region, the method comprising:

feeding a first yarn and a second yarn to the first region in a paralleled state so as to form a stitch course of the first region;

feeding the first yarn to the second region to form a first stitch course; and feeding the second yarn to the second region to form a second stitch course next to the first stitch course.

2. The method of knitting the knitting fabric according to claim 1, wherein the stitch course in the first region is formed by use of half gauge using alternate needles.

3. A knit fabric, which has at least a first region and a second region in a course including a stitch loop formed in the second region smaller in size than a stitch loop formed in the first region, wherein the first region has a stitch course formed by a first yarn and a second yarn which are parallel to each other; wherein the second region adjoining to the first region has two stitch courses comprising a first stitch course formed by the first yarn and a second stitch course formed by the second yarn next to the first stitch course.

4. The knitting fabric according to claim 3, wherein the stitch loop formed in the stitch course of the first region is, double as long as the stitch loop formed in the stitch course of the second region.

5. The method according to claim 1, wherein the first yarn and the second yarn are fed simultaneously to a same needle during the paralleled state.

6. The method according to claim 1, wherein a length of the knit fabrics in the first and second regions that form the respective first and second loops are equal.

7. The method according to claim 1, wherein the stitch course in the second region is formed by use of full gauge using all needles.

8. The method according to claim 2, wherein the stitch course in the second region is formed by use of full gauge using all needles.

9. The method according to claim 8, wherein the knit fabric used in the first region has a different texture than the knit fabric used in the second region.

10. The knit fabric according to claim 3, wherein the first yarn and the second yarn are fed simultaneously to the same needle during the paralleled state.

* * * * *

UNITED STATES PATENT AND TRADEMARK OFFICE

CERTIFICATE OF CORRECTION

PATENT NO. : 6,412,311 B1
DATED : July 2, 2002
INVENTOR(S) : Syunichi Nakai

It is certified that error appears in the above-identified patent and that said Letters Patent is hereby corrected as shown below:

Title page, Item [54] and Column 1, lines 1 and 2,
Correct the title to -- KNITTING FABRIC AND KNITTING METHOD THEREOF --.

Signed and Sealed this

Ninth Day of September, 2003

JAMES E. ROGAN
*Director of the United States Patent and Trademark Office*